US011946641B2

(12) United States Patent
Rush, III et al.

(10) Patent No.: US 11,946,641 B2
(45) Date of Patent: Apr. 2, 2024

(54) SPARK IGNITED PILOT FOR GAS BURNER

(71) Applicant: Solaronics, Inc., Auburn Hills, MI (US)

(72) Inventors: Richard Rush, III, Auburn Hills, MI (US); Thomas A. Martelle, Rochester Hills, MI (US)

(73) Assignee: Solaronics, Inc., Auburn Hills, MI (US)

( * ) Notice: Subject to any disclaimer, the term of this patent is extended or adjusted under 35 U.S.C. 154(b) by 468 days.

(21) Appl. No.: 17/333,076

(22) Filed: May 28, 2021

(65) Prior Publication Data

US 2022/0381431 A1 Dec. 1, 2022

(51) Int. Cl.
*F23Q 9/00* (2006.01)
*F23D 14/14* (2006.01)
*F23Q 9/02* (2006.01)

(52) U.S. Cl.
CPC ..... *F23D 14/14* (2013.01); *F23Q 9/02* (2013.01)

(58) Field of Classification Search
CPC ..... F23D 14/14; F23Q 9/02
USPC ..... 126/39 E
See application file for complete search history.

(56) References Cited

U.S. PATENT DOCUMENTS 3,174,534 A 3/1965 Weber
3,196,928 A 7/1965 Pointe et al.
3,947,231 A 3/1976 Smith
3,986,817 A 10/1976 Lambiris
4,141,213 A 2/1979 Ross
4,215,979 A 8/1980 Morishita
4,242,080 A 12/1980 Tabei
4,251,205 A 2/1981 Roeder et al.
4,315,729 A * 2/1982 Tanaka ..... F23D 14/72 431/75
4,626,196 A 12/1986 Stohrer, Jr.
4,806,095 A 2/1989 Goldstein et al.
5,813,845 A * 9/1998 Eiermann ..... F27D 99/0033 431/348
6,139,311 A * 10/2000 Bowman ..... F23C 7/02 431/278
6,345,979 B1 * 2/2002 Taylor ..... F23Q 9/00 431/353
2010/0108659 A1 * 5/2010 Lehman ..... F24C 3/087 219/400
2014/0080072 A1 * 3/2014 Smirnov ..... F23D 14/66 431/6
2015/0354810 A1 * 12/2015 Nakatani ..... F23D 14/62 431/354

* cited by examiner

*Primary Examiner* — Avinash A Savani
(74) *Attorney, Agent, or Firm* — Young Basile Hanlon & MacFarlane, P.C.

(57) ABSTRACT

A spark ignited, gas fueled pilot assembly compromising a bracket and a metal gas tube extending through the bracket and having an outlet end. The gas tube is surrounded by a ceramic jacket which is of such a length as to extend beyond the outlet end of the gas tube by approximately 0.03" such that the gas tube outlet is recessed into the ceramic jacket. The assembly further comprises a pair of ignitor electrodes carried by the bracket and arranged and located relative to the recessed gas supply tube to ignite fuel emanating therefrom.

4 Claims, 2 Drawing Sheets

SPARK IGNITED PILOT FOR GAS BURNER

FIELD OF THE INVENTION

The device described herein is in the field of spark ignited pilots for gas fueled burners.

BACKGROUND OF THE DISCLOSURE

Gas fired pilots are commonly used to start gas fired infrared burners used in food preparation as well as other applications. A typical pilot includes a metal gas supply tube mounted in association with a pair of electrodes forming a spark gap immediately above the gas tube outlet. Applying a voltage to one of the two electrodes while grounding the other can produce a spark in the gap thereby igniting gas coming from the tube.

BRIEF SUMMARY OF THE DISCLOSURE

This document describes a spark-ignited, gas-fueled pilot that may be used in combination with a gas fired burner wherein the pilot includes a bracket providing a mount for pair of spark gap electrodes as well as a metal gas supply tube and further wherein the metal gas supply tube is jacketed by a ceramic tube that is longer than the portion of the gas tube extending above the bracket surface. By virtue of this combination, the gas supply tube is recessed into the ceramic jacket, the result being a significant increase in the useful life of the pilot. As used herein, the term "gas" shall be construed to mean natural gas, propane, and other commonly available flammable gaseous products.

BRIEF DESCRIPTION OF THE DRAWINGS

The features and advantages of the invention described herein will become more apparent from a reading of the following description of an illustrative embodiment, taken with the attached to-scaled drawings of which.

DETAILED DESCRIPTION OF THE ILLUSTRATIVE EMBODIMENT

Figure 2:
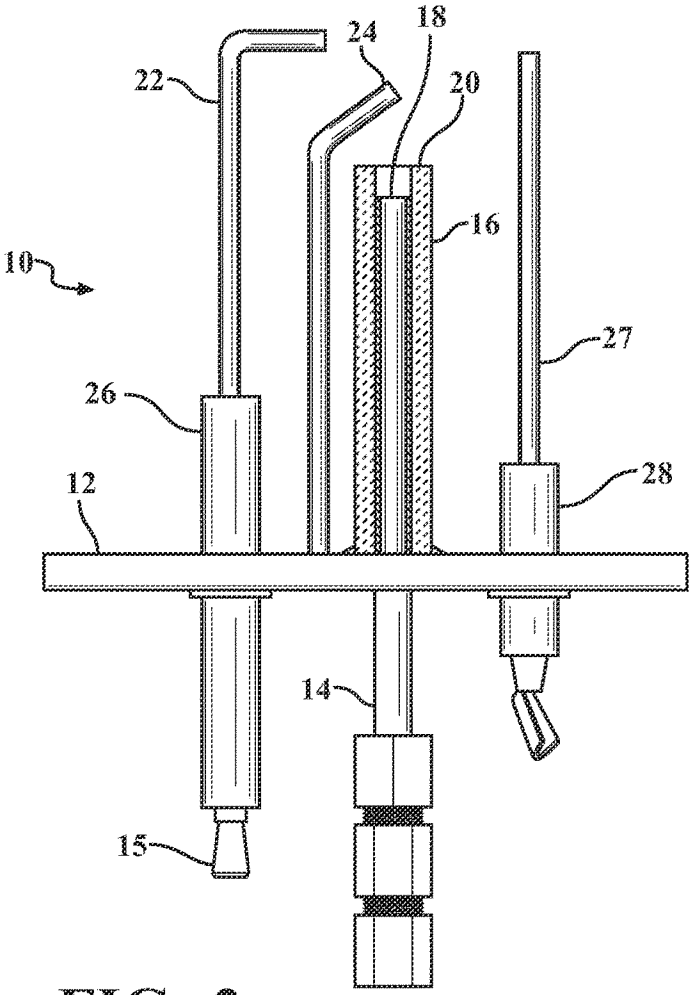
FIG. 2 is a sideview of the pilot assembly partly sectioned to show the recess of the gas tube relative to the surrounding ceramic jacket.
Figure 1:
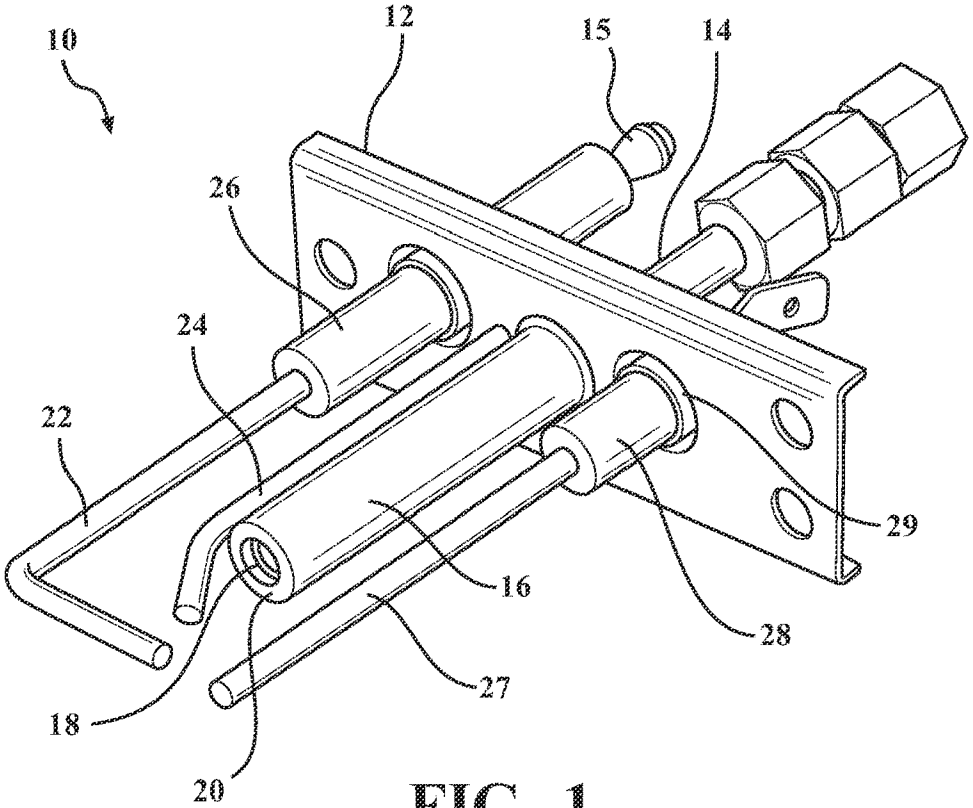
FIG. 1 is a view of an exemplary pilot assembly including a mounting bracket, spark gap igniter electrodes, a jacketed gas supply tube and a sensor probe.

Referring to FIGS. 1 and 2, a gas-fired, spark-ignited pilot assembly 10 is shown to comprise a metal support member in the form of a bracket 12. Extending through and carried by the bracket 12 is a small diameter gas supply tube 14 having a surrounding ceramic jacket 16 in direct contacting association therewith. As best shown in FIG. 2, the jacket 16 rests on the top surface of the bracket and has a length which is greater than the length of the gas supply tube above the surface of the bracket 12 such that the outlet end 18 of the gas supply tube is recessed into the jacket 16 and below the top surface thereof by appropriately 0.030'. The bottom edge of the ceramic jacket is sealed around the joint with the bracket surface as shown.

A spark gap ignitor for the pilot assembly 10 comprises an L-shaped high voltage electrode 22 and a grounded electrode 24 arranged relative to the electrode 22 so as to define a spark gap which is close to the outlet of the pilot gas tube 14 and the top of the jacket 16. The high voltage electrode 22 is mounted within a ceramic insulator 26 which extends through and is attached to the bracket 12 with a suitable connector 15 for attachment to a high voltage supply.

The assembly 10 further comprises a sensor probe 27 of heat sensitive metal extending through a ceramic insulator 28 which is attached to and extends through the bracket 12. The probe 27 is known in the art and senses heat from the pilot assembly when it is active; i.e. that the gas being emitted from the end of the tube 14 and jacket 16 and has been ignited and is burning. The ceramic jacket 16 does not serve any purpose as an insulator, does not extend through the bracket 12, but, rather, is sealingly attached to the top planar surface thereof. The inside diameter of the jacket 16 is such as to produce a close fit with the gas supply tube 14.

The preferred ceramic for the jacket 16 is alumina but other ceramics such as Si2O3 can also be used. The outside diameter of the ceramic jacket 16 is on the order of ⅜" whereas the outside diameter of the gas tube 14 is on the order of 3/16", these dimensions being representative of a typical device and not intended to be limiting. The recess is on the order of 0.030" in a pilot assembly having the aforementioned dimensions.

INDUSTRIAL APPLICABILITY

Figure 3:
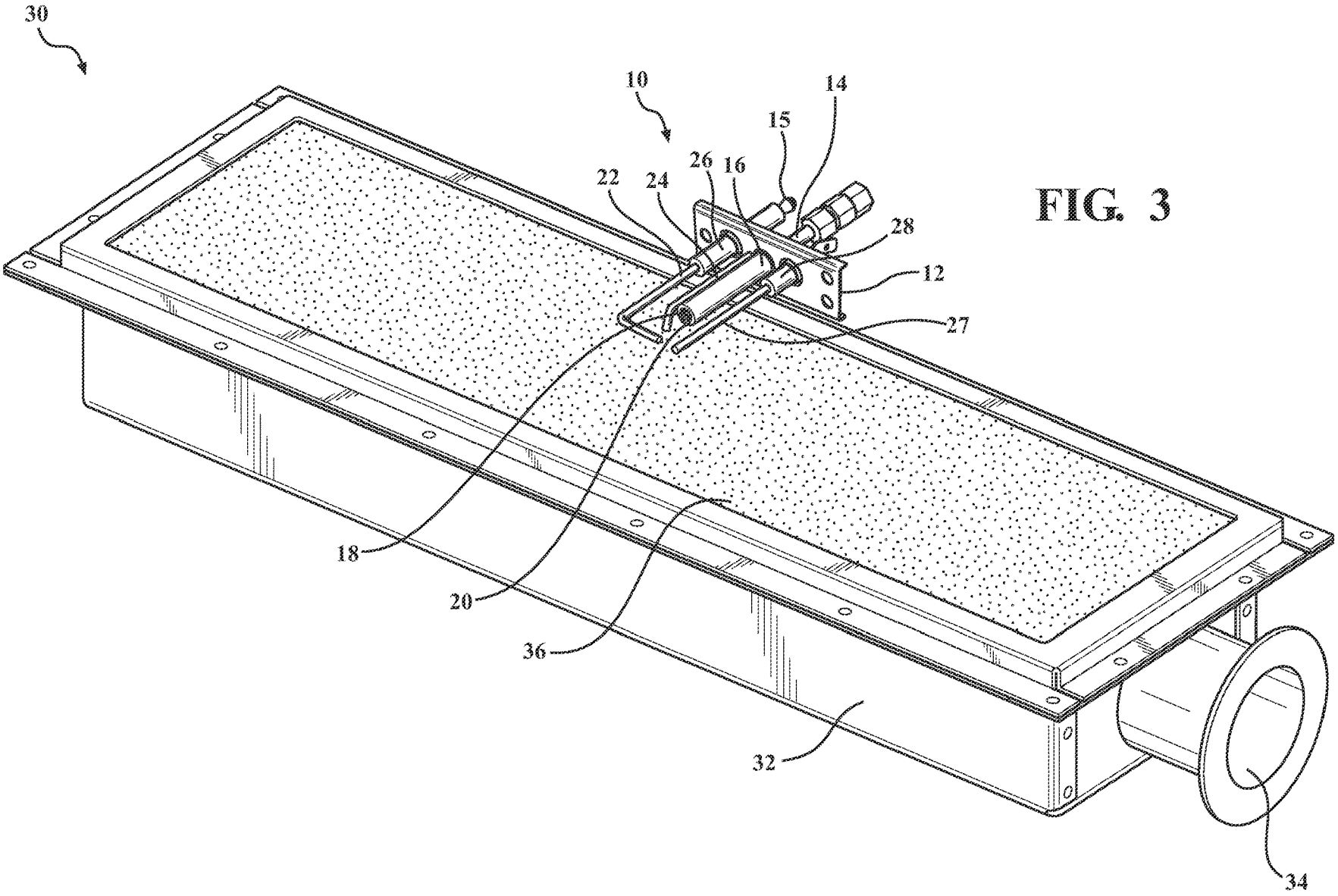
FIG. 3 is a perspective view of an infrared gas fire burner as an illustration of how the pilot assembly can be found in an industrial application.

FIG. 3 shows in perspective an infrared burner 30 having a generally rectangular metal housing 32 with an inlet 34 for a fuel/air mixture. The housing 32 makes up a plenum chamber in which the fuel and air are thoroughly mixed and are emitted upwardly and outwardly through a assembly comprising a porous open cell medium 36 through which the distributed fuel/air mixture passes and is ignited by the pilot assembly 10 which is shown attached by means of the bracket 12 to a side of the housing 32 with the gas tube, outlet and the ignitor electrodes located close to the surface of the medium 36. A more detailed description of the burner 30 can be found in the co-pending application Ser. No. 16/454,509 filed Jun. 27, 2019 and entitled "Gas-fired Infrared Burner", the complete disclosure of which is incorporated herein by reference.

It is to be understood that the inventive subject matter of this document is and has been described with reference to an illustrative embodiment and various modifications and additions to the embodiment may be made to fit a particular application.

What is claimed:

1. A spark ignited, gas fueled pilot assembly comprising:

a support bracket;

a metal gas tube extending through and carried by the support bracket and having an outlet end;

a tubular ceramic jacket attached in direct and surrounding contact with the outer surface of a length of the gas tube between the support bracket and the outlet end, the ceramic jacket extending a fraction of an inch beyond the outlet end of the gas tube whereby the gas tube end is recessed into the ceramic jacket; and the assembly further comprising a set of spark gap electrodes carried by the support member and configured and located to ignite gas emanating from the gas tube.

2. A spark ignited, gas fueled pilot assembly as defined in claim 1 wherein the jacket is made of alumina.

3. A spark-ignited, gas-fueled pilot assembly as defined in claim 1 wherein the ceramic jacket extends approximately 0.030" beyond the outlet end of the gas tube.

4. An infrared radiator/burner comprising:

a burner assembly having a plenum chamber with a fuel/air mixture inlet and a radiator panel attached to the plenum and having an exposed surface; the combination further comprising a spark-ignited, gas-fueled pilot assembly as defined in claim 1 attached to the plenum chamber and located in spaced relationship with the radiator panel to ignite a fuel air mixture passing therethrough.

* * * * *